US008147389B1

(12) United States Patent
Hoole

(10) Patent No.: US 8,147,389 B1
(45) Date of Patent: Apr. 3, 2012

(54) ADJUSTABLE WEIGHT-LOADED DIP-CHIN MACHINE

(76) Inventor: Richard J. Hoole, New Smyrna Beach, FL (US)

( * ) Notice: Subject to any disclaimer, the term of this patent is extended or adjusted under 35 U.S.C. 154(b) by 0 days.

(21) Appl. No.: 12/658,855

(22) Filed: Feb. 16, 2010

Related U.S. Application Data

(63) Continuation-in-part of application No. 11/811,920, filed on Jun. 11, 2007, now Pat. No. 7,871,360, and a continuation-in-part of application No. 12/156,487, filed on Jun. 2, 2008, now Pat. No. 7,918,770.

(51) Int. Cl.
*A63B 21/00* (2006.01)

(52) U.S. Cl. ..... 482/100; 482/37; 482/15; 482/97; 482/104

(58) Field of Classification Search ..... 482/93, 482/102, 104, 106, 121, 10, 11, 44, 14, 15, 482/94–100; 128/848, 861, 201.1; 473/441, 473/442; 446/491
See application file for complete search history.

(56) References Cited

U.S. PATENT DOCUMENTS

| | | | | |
|---|---|---|---|---|
| 3,207,511 | A | 9/1965 | Hoffman | |
| 3,707,285 | A | 12/1972 | Martin | |
| 3,861,675 | A | 1/1975 | Hopper | |
| 4,111,414 | A | 9/1978 | Roberts | |
| 4,188,029 | A | 2/1980 | Brower et al. | |
| 4,372,553 | A | 2/1983 | Hatfield | |
| 4,620,701 | A * | 11/1986 | Mojden | 482/41 |
| 4,645,197 | A | 2/1987 | McFee | |
| 5,277,684 | A | 1/1994 | Harris | |
| 5,322,489 | A * | 6/1994 | Webb et al. | 482/38 |
| 5,372,556 | A * | 12/1994 | Ropp | 482/41 |
| 5,496,242 | A | 3/1996 | Wang | |
| 5,580,340 | A | 12/1996 | Yu | |
| 7,083,552 | B2 * | 8/2006 | Carter | 482/93 |
| 7,166,066 | B2 | 1/2007 | Webber | |
| 2002/0132706 | A1 | 9/2002 | Sleamaker | |
| 2004/0018921 | A1 | 1/2004 | Smith | |
| 2005/0096198 | A1 | 5/2005 | Webber et al. | |
| 2007/0197353 | A1 | 8/2007 | Hundley | |

* cited by examiner

*Primary Examiner* — Jerome W Donnelly
(74) *Attorney, Agent, or Firm* — Paul S. Rooy PA

(57) ABSTRACT

An adjustable weight-loaded dip-chin machine. Dip bars and chin bars with means for vertical adjustment are mounted on columns, which in turn are mounted on a base. An arm is pivotally attached to the base, and weights can be added to an arm spindle attached to the arm. A belt is attached to the arm, and the weighted arm spindle resist upward exerciser motion when performing dips or chins. A pivot hook releasably engages the arm spindle in an elevated position for convenience and safety when commencing and ending a squat exercise series. Means are disclosed for adjusting the height of the pivot hook on a column, and for automatically disengaging the pivot hook from the arm spindle when exercise commences. A squat platform is sized to fit between foot platforms, which together form a stable standing area for the exerciser. Squat handles are height-adjustably mounted to the columns.

24 Claims, 16 Drawing Sheets

ADJUSTABLE WEIGHT-LOADED DIP-CHIN MACHINE

CLAIM FOR PRIORITY

This application based on, and is a continuation-in-part, of U.S. patent application Ser. No. 11/811,920 filed Jun. 11, 2007, now U.S. Pat. No. 7,871,360 and of U.S. patent application Ser. No. 12/156,487 filed Jun. 2, 2008, now U.S. Pat. No. 7,918,770 and claims the benefit of the earlier filing date of these applications.

BACKGROUND OF THE INVENTION

1. Field of the Invention

This invention relates to exercise machines, and in particular to an adjustable weight-loaded dip-chin machine.

2. Background of the Invention

The dip-chin machine is one of the most important exercise machine available. This machine uses the resistance of one's own body to work the biceps, forearms, lateral muscles, triceps, chest, and shoulder muscles. Bars are provided for both dips and chins (also known as "chin-ups").

Dips are performed by pushing oneself above the level of a pair of parallel dip bars located approximately shoulder-width apart. The exerciser grasps a dip bar with each hand, then lowers his or her body until elbows are bent and shoulders mildly stretched. The arms are used to push the exerciser upwards to the starting position. Leaning the body forward with elbows kept in works the chest muscles more. Keeping the body straight vertically with elbows close to the body works the triceps more. More strenuous dips can be accomplished by not permitting the exerciser's feet to touch the floor at all during the course of the exercise.

Chins are performed by pulling oneself upwards above a pair of roughly co-linear chin bars, grasping one bar with each hand. The chin bars are located above the shoulder height of the exerciser. The exerciser begins by grasping a chin bar with each hand, with palms facing the exerciser. The exerciser then pulls himself or herself upwards until either chin or chest touches the chin bars. The exerciser then slowly lowers himself or herself back to the standing position from which the chin exercise was initiated. Chin exercises strengthen the biceps, forearms, and lateral muscles.

One problem associated with current dip-chin machines is the inability to hook an arm bearing a weighted spindle in an elevated position, so that an exerciser may commence a squat series from a relatively erect position, and go as low as desired during subsequent squats. It would also be desirable to provide means to automatically release a hook holding the arm elevated when exercise commences.

Another problem with currently existing dip-chin machines is the absence of a solid platform to stand on, which is capable of accommodating different sized exercisers. The best foot support currently available is a pair of widely-spaced-apart foot supports, with a void in between which the exerciser could fall or slip into.

Still another problem associated with current dip-chin machines is the absence of an easily height-adjustable pair of squat handles, to aid in the squat exercise series.

Another problem associated with existing dip-chin machines is the lack of adjustability, either vertically or horizontally, of the dip bars and chin bars. This renders exercise difficult for non-standard sized exercisers. In addition, it would be desirable to vary the positions of the dip bars and chin bars in order to adjust the strenuousness of the dips and chins being performed, and to allow the exerciser to use the machine from an initial position standing either on the ground or on foot supports. This flexibility of use is not attainable unless the dip bars and chin bars are rendered adjustable on the dip-chin machine.

Still another problem associated with currently available dip-chin machines is the inability to add resistance acting against the exerciser's upward motion during dips and chins, thereby rendering the exercise more strenuous. Currently available dip-chin machines are either not weightable, or provide means to use weights to aid the exerciser during the exercise, thus rendering the exercise less strenuous. Thus, in order to make the dips and chins more strenuous it would be desirable to provide means of adding weight against the exercise being performed, not in aid of the exercise. In addition, it would be desirable to provide means for using elastic to work against the exercise, thus increasing the exercise value.

One currently available option is for the exerciser to wear a weight belt, from which weights dangle. While these weights have the effect of increasing the weight of the exerciser, and hence the strenuousness of the exercise, the procedure can be dangerous if the weights swing into the exerciser's limb(s), or if the exerciser were to slip off of the elevated foot support(s) and the heavy weights land on the exerciser's feet or other body part. Thus, it would be desirable to provide a safe way to add weight against the dip or chin being performed.

SUMMARY OF THE INVENTION

Accordingly, it is an object of this invention to provide an adjustable weight-loaded dip-chin machine to which provides a stable standing area for the exerciser. Design features enabling the accomplishment of this object include a squat platform having substantially the same height as a pair of foot supports. Advantages associated with the realization of this object include increased stability and safety to exercisers using the machine.

It is another object of this invention to provide an adjustable weight-loaded dip-chin machine which provides an automatically-releasing means to hold its arm in an elevated position. Design features enabling the accomplishment of this object include a pivot hook rotatably attached to a column. Advantages associated with the realization of this object include increased ease of use and safety to exercisers using the machine, because exercisers can set the amount of weights desired, attach a belt line hook to the arm while the arm is elevated, raise the arm by standing up out of the mild squat required to attach the belt line hook to the arm, and then during subsequent exercise squat as low as desired.

It is yet another object of this invention to provide an adjustable weight-loaded dip-chin machine with variable-height squat handles. Design features allowing this object to be achieved include squat handles sized to removably fit into column apertures. Benefits associated with reaching this objective include increased convenience and effectiveness of squat exercises.

It is another object of the present invention to provide an adjustable weight-loaded dip-chin machine which provides a varying amount of weight which the exerciser can add acting against the dip or chin being performed. Design features allowing this object to be accomplished include an arm pivotally attached to a frame, an arm spindle on the arm, and weights sized to fit onto the arm spindle. Advantages associated with the accomplishment of this object include the ability to adjust the intensity of dips and chins being performed, and the consequent enhancement of the exercise experience to the exerciser.

It is another object of the present invention to provide an adjustable weight-loaded dip-chin machine which provides a varying amount of resistance which the exerciser can add acting against the dip or chin being performed. Design features allowing this object to be accomplished include an arm pivotally attached to a frame, at least one pin attached to the frame, and an elastic band connecting a pin with the arm spindle, and/or an elastic band connecting a pin with a belt worn by the exerciser, and/or weights depending from the belt worn by the exerciser. Advantages associated with the accomplishment of this object include the ability to adjust the intensity of dips and chins being performed, and the consequent enhancement of the exercise experience to the exerciser.

It is still another object of this invention to provide an adjustable weight-loaded dip-chin machine to which weights and force which resist the dips and chins being performed may be added safely. Design features enabling the accomplishment of this object include an arm pivotally attached to a frame, an arm spindle attached to the arm, weights which may be removably installed on the arm spindle, and a belt worn by the exerciser attached to the arm by means of a belt line. Advantages associated with the realization of this object include elimination of the necessity for an exerciser to climb up onto elevated foot supports bearing heavy weights dangling from a weight belt, and elimination of the possibility of injury to the exerciser from these weights.

It is still another object of this invention to provide an adjustable weight-loaded dip-chin machine to which provides varying distances between dip bar and belt attach points. Design features enabling the accomplishment of this object include an arm pivotally attached to a frame, an arm extension rigidly attached to and end of the arm opposite the frame, and dip bars attached to the frame, each having a plurality of legs spaced at differing distances from each other. Advantages associated with the realization of this object include the ability to accommodate varying sizes of exercisers using the machine.

It is yet another object of this invention to provide an adjustable weight-loaded dip-chin machine which is inexpensive to manufacture. Design features allowing this object to be achieved include the use of components made of readily available materials, and the use of existing weights which may be removably added to an arm spindle. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Sixteen sheets of drawings are provided. Sheet one contains FIG. 1. Sheet two contains FIG. 2. Sheet three contains FIG. 3. Sheet four contains FIGS. 4 and 5. Sheet five contains FIGS. 6 and 7. Sheet six contains FIGS. 8 and 9. Sheet seven contains FIGS. 10 and 11. Sheet eight contains FIG. 12. Sheet nine contains FIG. 13. Sheet ten contains FIG. 14. Sheet eleven contains FIG. 15. Sheet twelve contains FIG. 16. Sheet thirteen contains FIGS. 17 and 18. Sheet fourteen contains FIG. 19. Sheet fifteen contains FIGS. 20 and 21. Sheet sixteen contains FIGS. 22 and 23.

DETAILED DESCRIPTION OF THE PREFERRED EMBODIMENT

Figure 1:
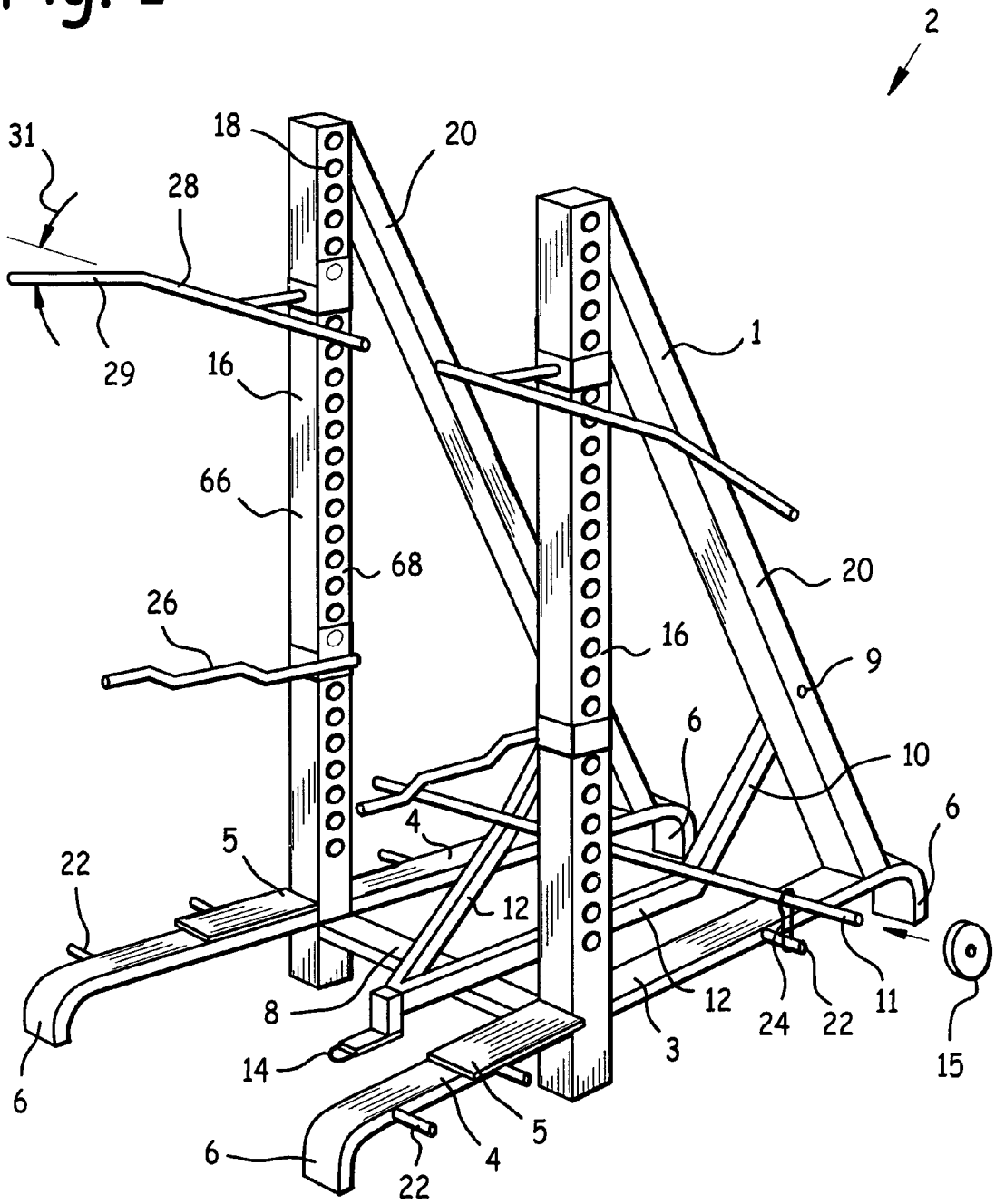
FIG. 1 is a right quarter side isometric view of an adjustable weight-loaded dip-chin machine.

Referring now to FIG. 1 we observe a right quarter side isometric view of adjustable dip-chin machine 2. Frame 1 is supported by base 3, and arm 10 is pivotally attached to frame 1 at arm pivot point 9. Arm 10 incorporates arm spindle 11, to which weights 15 may be removably attached. It is contemplated to fall within the scope of this invention that arm 10 may be pivotally attached to base 3, or pivotally attached to frame 1. Even if arm 10 is pivotally attached to frame 1, frame 1 is attached to base 3, so in this case it can fairly be said that arm 10 is pivotally mounted to base 3 by means of frame 1.

Frame 1 includes a pair of columns 16. Each column 16 has a dip bar 26 and/or a chin bar 28 adjustably attached to it. Thus, the instant invention teaches that each dip bar 26 and chin bar 28 may be adjusted along the height of a respective column 16, thereby rendering the instant adjustable dip-chin machine 2 the correct size for different exercisers, and also permitting the strenuousness of the exercises being performed to be varied.

Base 3 includes a pair of foot supports 5, which are elevated relative to a surface upon which adjustable dip-chin machine 2 rests. Thus, an exerciser using adjustable dip-chin machine 2 may stand on foot supports 5, or the surface upon which adjustable dip-chin machine 2 rests, while performing dips and/or chins.

In the preferred embodiment frame 1 comprised a pair of substantially parallel vertical columns 16, each supported by a column brace 20 extending from a respective column 16 to a rear portion of base 3. A rear extreme of arm 10 was pivotally attached to column braces 20. A forward portion of arm 10 rested on arm support 8, which extended horizontally between columns 16. Arm 10 comprised a pair of arm braces 12, one end of each arm brace 12 was rotatably attached to a respective column brace 20 at an arm pivot point 9, opposite ends of the arm braces were mutually attached, and arm ring 14 was attached to the end of the arm braces 12 opposite column braces 20. Each column 16 comprised a pair of opposed column faces 66 and column sides 68. A plurality of column apertures 18 were disposed in one column side 68, whereby the height of dip bar 26 and chin bar 28 could be adjusted.

In the preferred embodiment, base 3 included a pair of substantially parallel legs 4 extending from the rear to the front of adjustable dip-chin machine 2. Each leg 4 was supported at each end by a foot 6, and a foot support 5 was disposed atop each leg 4 forward of a column 16. At least one peg 22 was attached to base 3, in the preferred embodiment to leg 4 and/or foot support 5, to which elastic band(s) 24 could be attached to a belt 30 worn by the exerciser, and/or to arm spindle 11. Depending on the number and elasticity of elastic bands 24 connecting belt 30 and/or arm spindle 11 to pegs 22, the strenuousness of the exercise could be varied.

Figure 2:
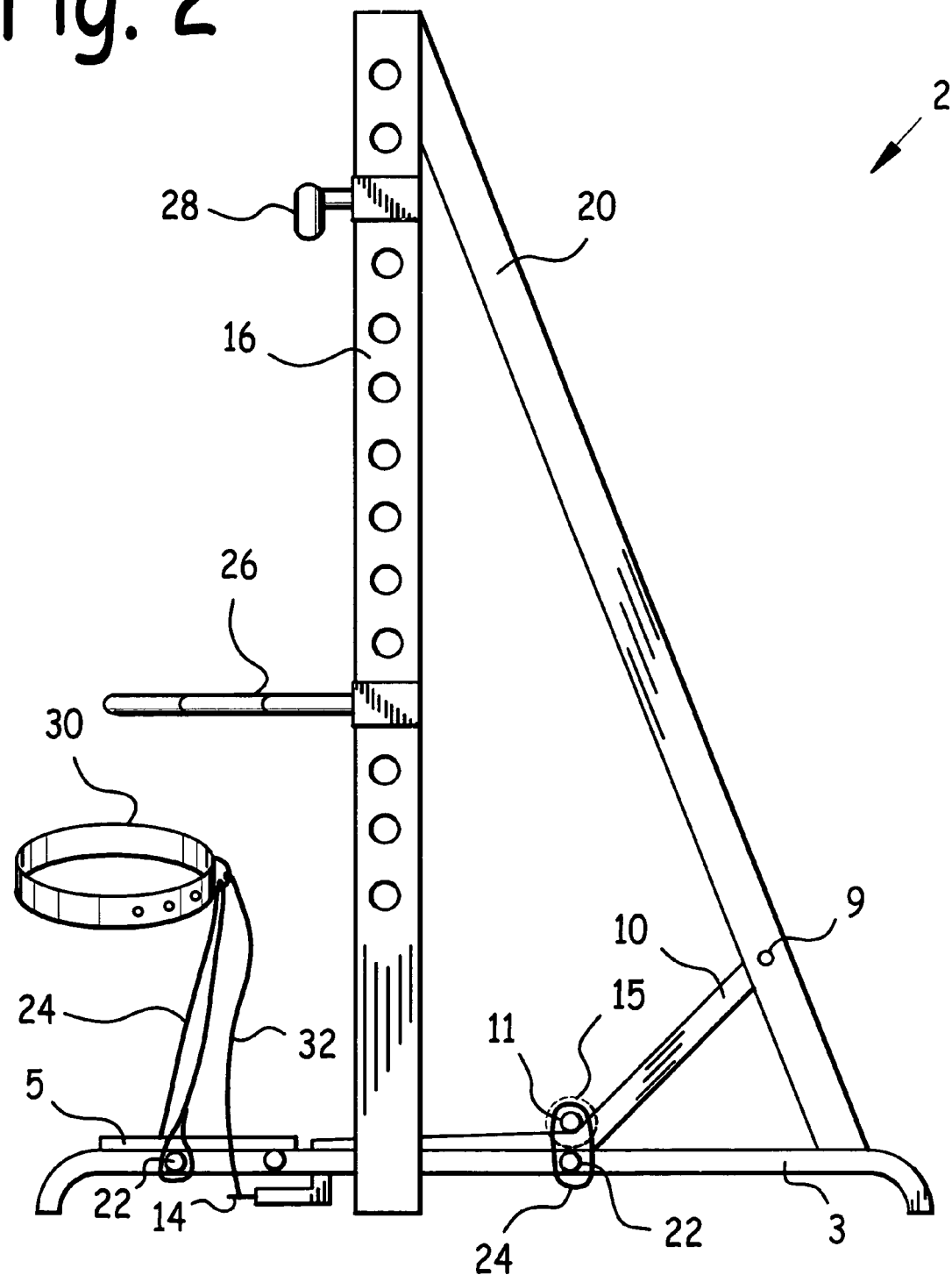
FIG. 2 is a right side view of an adjustable weight-loaded dip-chin machine with its arm in the resting position.
Figure 3:
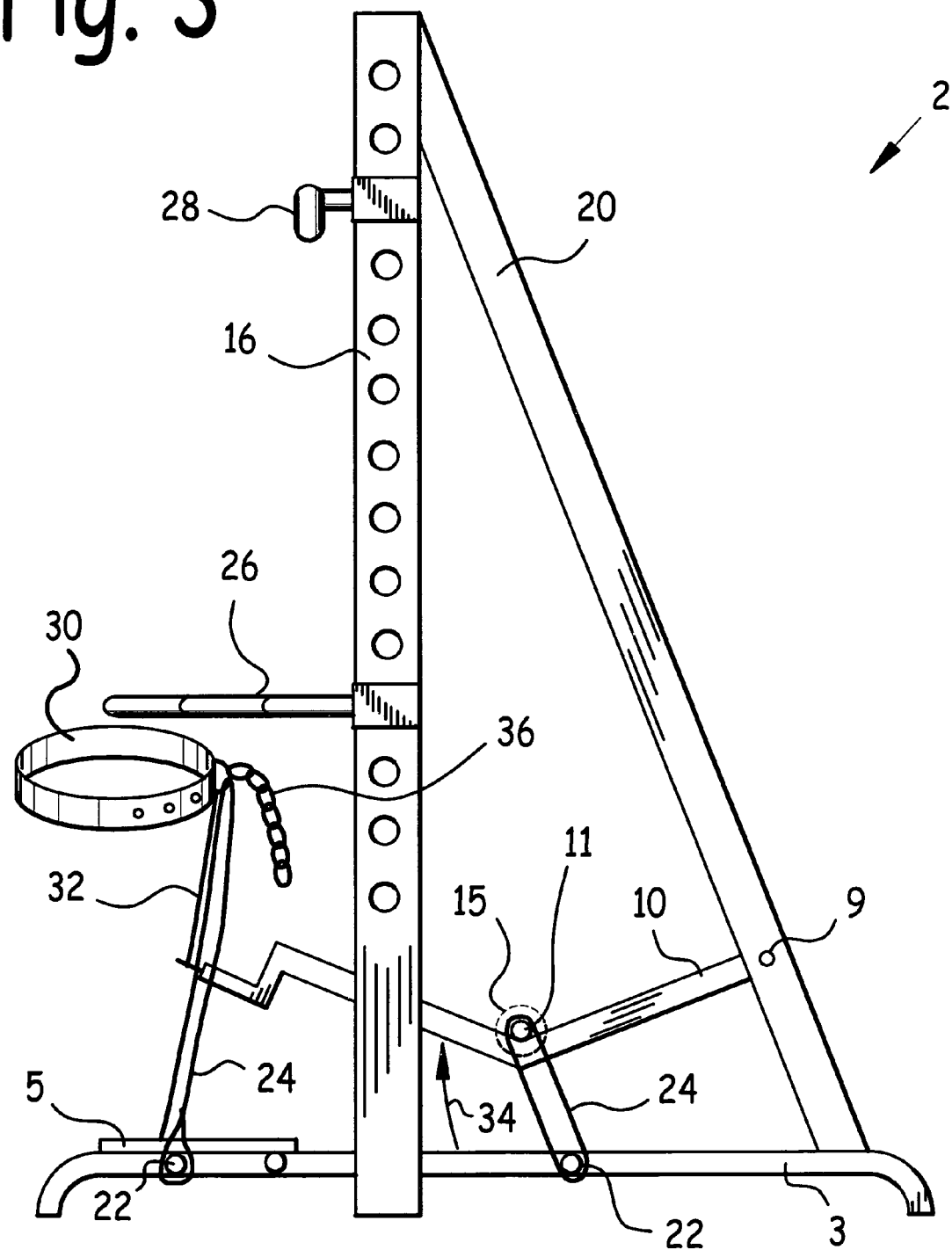
FIG. 3 is a right side view of an adjustable weight-loaded dip-chin machine with its arm in the elevated position.

FIG. 2 is a right side view of adjustable dip-chin machine 2 with its arm 10 in the resting position on arm support 8. FIG. 3 is a right side view of adjustable dip-chin machine 2 with its arm 10 in the elevated position. As may be observed in these figures, belt 30 (fastened around the waist of an exerciser, not shown) is attached to arm 10 by belt line 32, at arm ring 14. As an exerciser moves upwards while performing a dip or chin, so also does belt 30, and arm 10 as indicated by arrow 34 in FIG. 3, because belt 30 is attached to arm 10 by means of belt line 32.

Arm 10 may be weighted down by a variable number of weights 15 on arm spindle 11, as desired by the exerciser or the trainer. In addition, one or more elastic bands 24 may be placed around arm spindle 11 and peg(s) 22 attached to frame 1, and one or more elastic bands 24 can attach belt 30 and peg(s) 22, as depicted in FIGS. 2 and 3. Finally, belt weight 36 such as chain or other appropriate weight may be attached to belt 30, as shown in FIG. 3. Weights 15, elastic bands 24, and chain 36 exert force against the exerciser's upward motion while performing dips and chins, thus increasing the strenuousness of these exercises as desired by the exerciser and/or the trainer.

Figure 4:
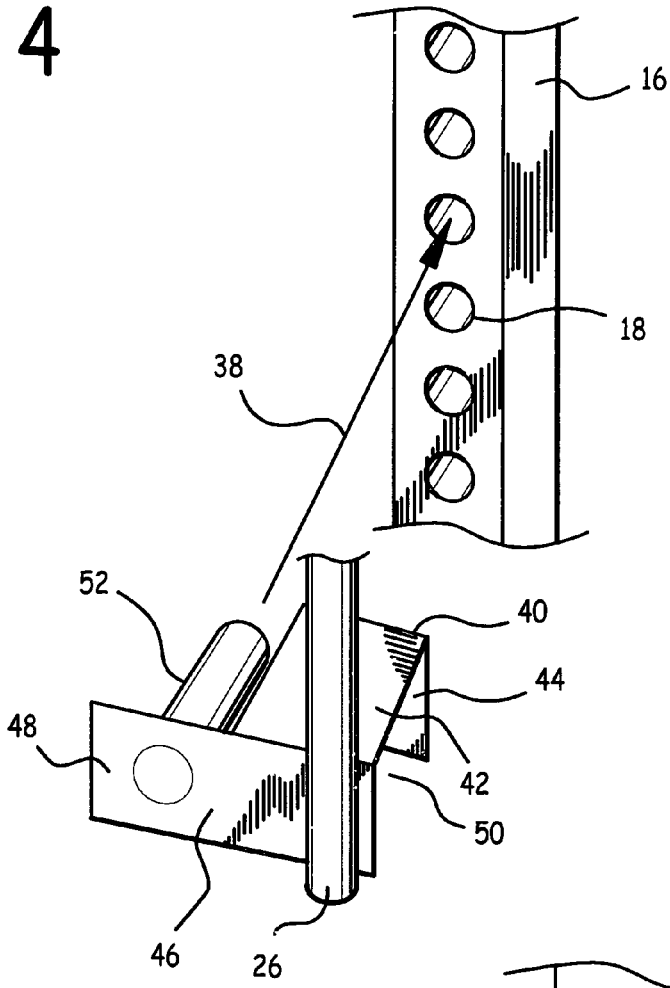
FIGS. 4-6 depict a dip bar bracket being installed on a column.
Figure 5:
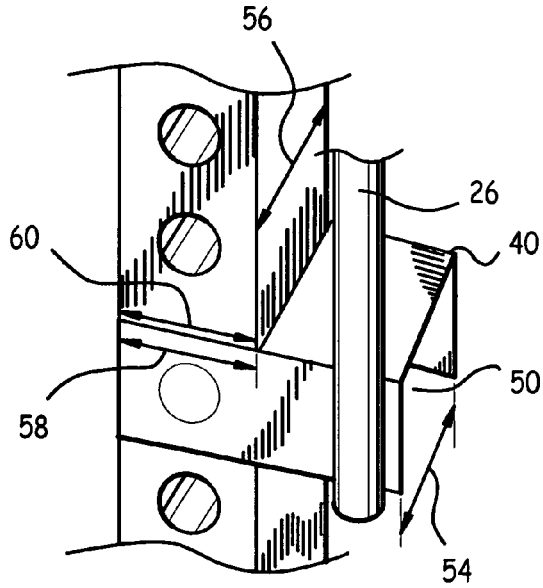
Figure 6:
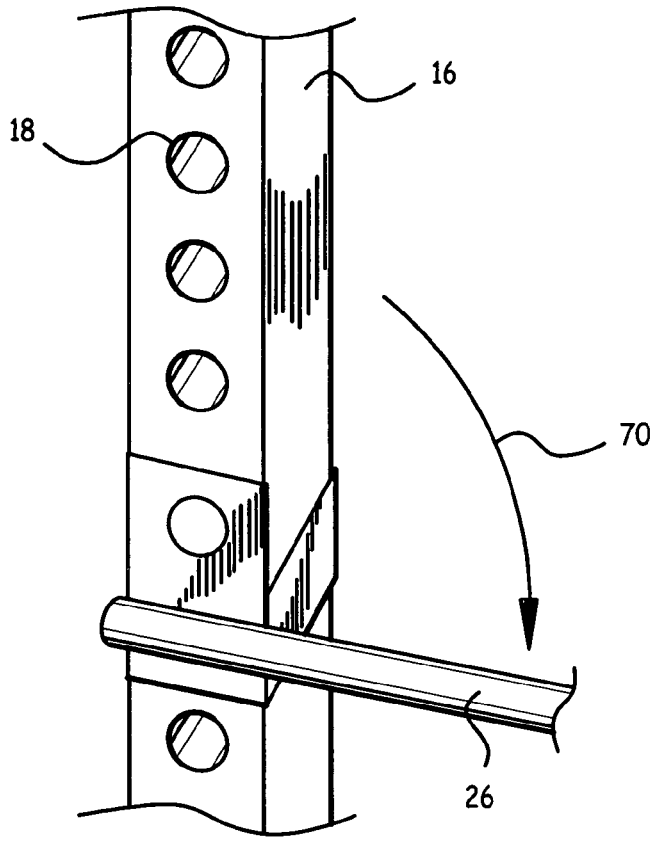

An important feature of the instant invention is the vertical adjustability of dip bars 26 along columns 16. FIGS. 4-6 depict a dip bar 26 bracket 40 being installed on a column 16. Bracket 40 comprises bracket first leg 44 attached along one edge of bracket spine 42, and bracket second leg 46 attached along an opposite edge of bracket spine 42. Bracket first leg 44, bracket spine 42, and bracket second leg 46 define bracket aperture 50, sized to admit column 16.

Bracket second leg 46 comprises bracket second leg extension 48, to which bracket pin 52 is rigidly attached. Each column 16 comprises a plurality of column apertures 18 sized to slidably admit bracket pin 52.

Figure 7:
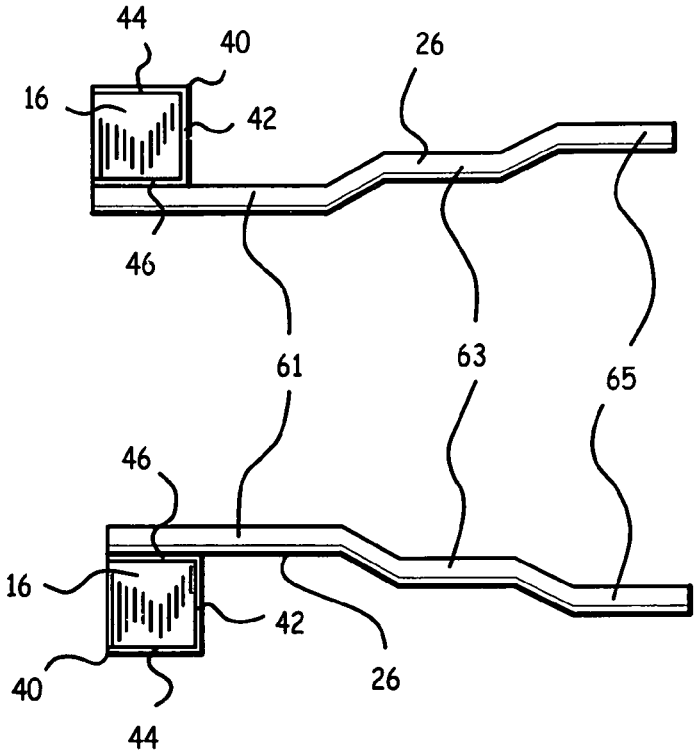
FIG. 7 is a top view of pair of dip bars mounted to respective columns 16, showing a provision of the instant invention to accommodate different sized exercisers by varying the distance between the two dip bars.

Bracket 40 is installed on column 16 by first inserting bracket pin 52 into a column aperture 18 at the desired height on column 16, as indicated by arrow 38 in FIG. 4. After bracket pin 52 is inserted in a column aperture 18 as depicted in FIG. 5, bracket 40 is rotated down around bracket pin 52 as indicated by arrow 70 in FIG. 6 until column 16 is disposed within bracket aperture 50, as depicted in FIGS. 6 and 7.

Bracket 40 may be re-positioned on column 16 by merely reversing the above steps, and then re-installing bracket 40 on column 16 using a different column aperture 18, as desired.

As illustrated in FIG. 5, in the preferred embodiment bracket aperture width 54 was substantially equal to or greater than column width 56, thus permitting column 16 to fit into bracket aperture 50. In addition, in the preferred embodiment bracket second leg extension depth 58 was substantially equal to column depth 60, thus permitting bracket pin 52 to fit into column aperture 18.

Figure 9:
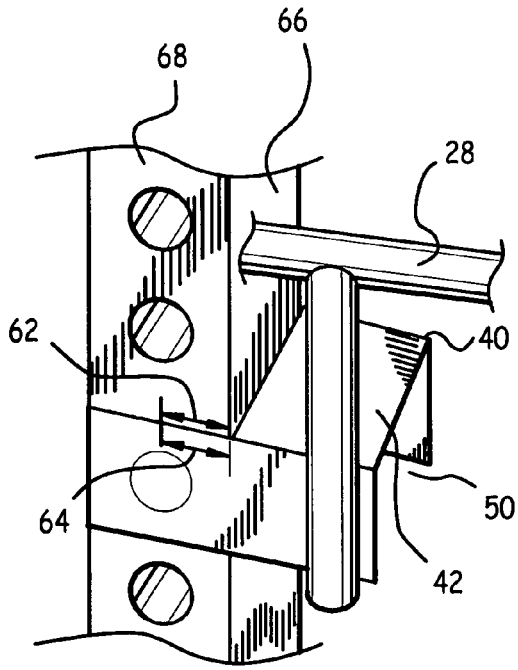

Another way of describing the dimensional relationship between bracket pin 52 on bracket 40 relative to column apertures 18 on column 16 is depicted in FIG. 9, which illustrates that bracket pin offset 64 (from bracket spine 42) is equal to or greater than column aperture offset 62 (from column face 66), thus affording bracket pin 52 the offset clearance required for it to slide into a column aperture 18.

FIG. 7 is a top view of a pair of dip bars 26, each mounted to a respective column 16, showing a provision of the instant invention to accommodate different sized exercisers by varying the distance from the other dip bar 26. In the embodiment depicted in FIG. 7, each dip bar 26 comprised a dip bar first leg 61, a dip bar second leg 63 spaced farther away from the other dip bar 26 than dip bar first leg 61, and a dip bar third leg 65, spaced farther away from the other dip bar 26 than dip bar second leg 63. As may be observed in FIG. 7, the farther the exerciser moves from columns 16, the farther apart dip bars 26 are spaced. The exerciser has merely to choose the dip bar 26 separation best suited for the dips being performed.

Figure 8:
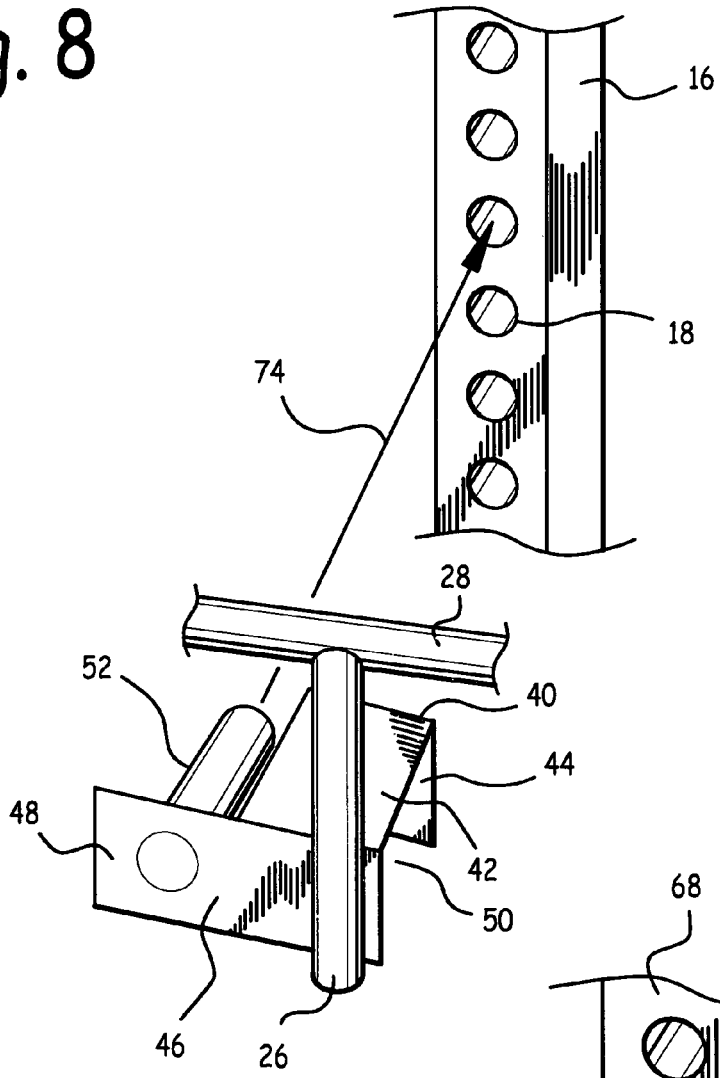
FIGS. 8-10 depict a chin bar bracket being installed on a column.
Figure 10:
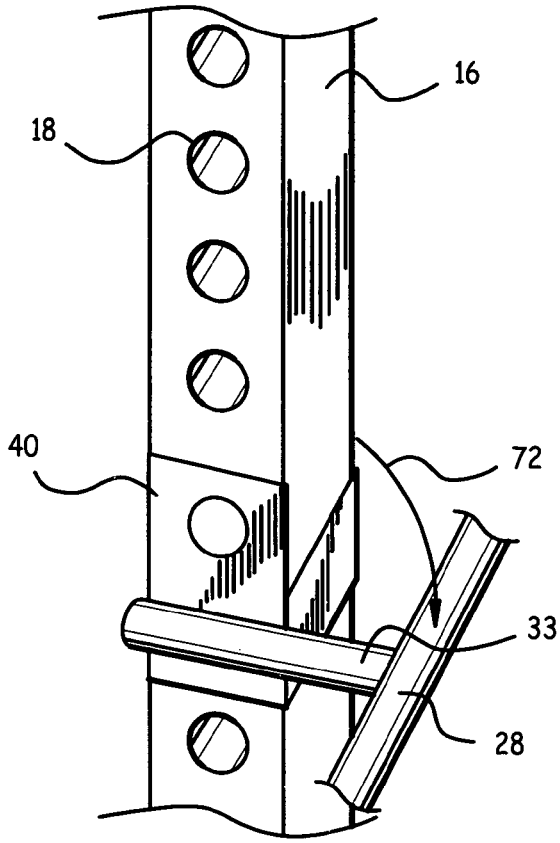

FIGS. 8-10 depict a chin bar 28 bracket 40 being installed on a column 16. The apparatus and method of installation are the same as for bracket 40 with dip bar 26 attached as described above. Bracket 40 is installed on column 16 by first inserting bracket pin 52 into a column aperture 18 at the desired height on column 16, as indicated by arrow 74 in FIG. 8. After bracket pin 52 is inserted in a column aperture 18 as depicted in FIG. 9, bracket 40 is rotated down around bracket pin 52 as indicated by arrow 72 in FIG. 10 until column 16 is disposed within bracket aperture 50, as depicted in FIGS. 10 and 11.

Bracket 40 may be re-positioned on column 16 by merely reversing the above steps, and then re-installing bracket 40 on column 16 using a different column aperture 18, as desired.

Figure 11:
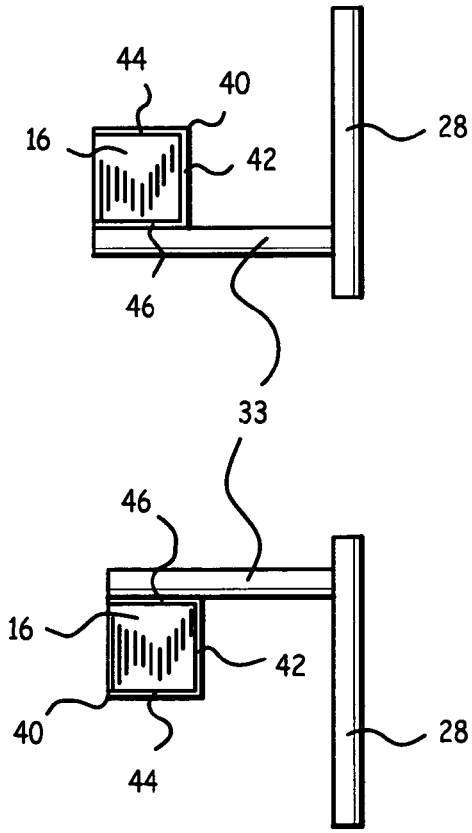
FIG. 11 is a top view of a pair of chin bars 28 mounted to respective columns 16.

FIG. 11 is a top view of a pair of chin bars 28 mounted to respective columns 16 using brackets 40. Chin bar 28 is attached to, and offset from, bracket 40 by means of chin bar support 33. Chin bar support 33 serves to offset chin bar 28 away from column 16 in the direction of the exerciser, thus rendering use of the instant adjustable dip-chin machine more ergonomic and user-friendly.

Referring now also to FIG. 1, each chin bar comprises down-sloping chin bar dogleg 29 attached to chin bar 28 at chin bar dogleg angle 31. The down slope of chin bar dogleg 29 renders chin bar 28 easier to use because it serves to effectively vary the distance between the exerciser and chin bar 28: the farther from columns 16, the lower chin bar dogleg 29 slopes. It was determined experimentally that a chin bar dogleg angle 31 substantially between 5 degrees and 25 degrees was optimal.

Figure 12:
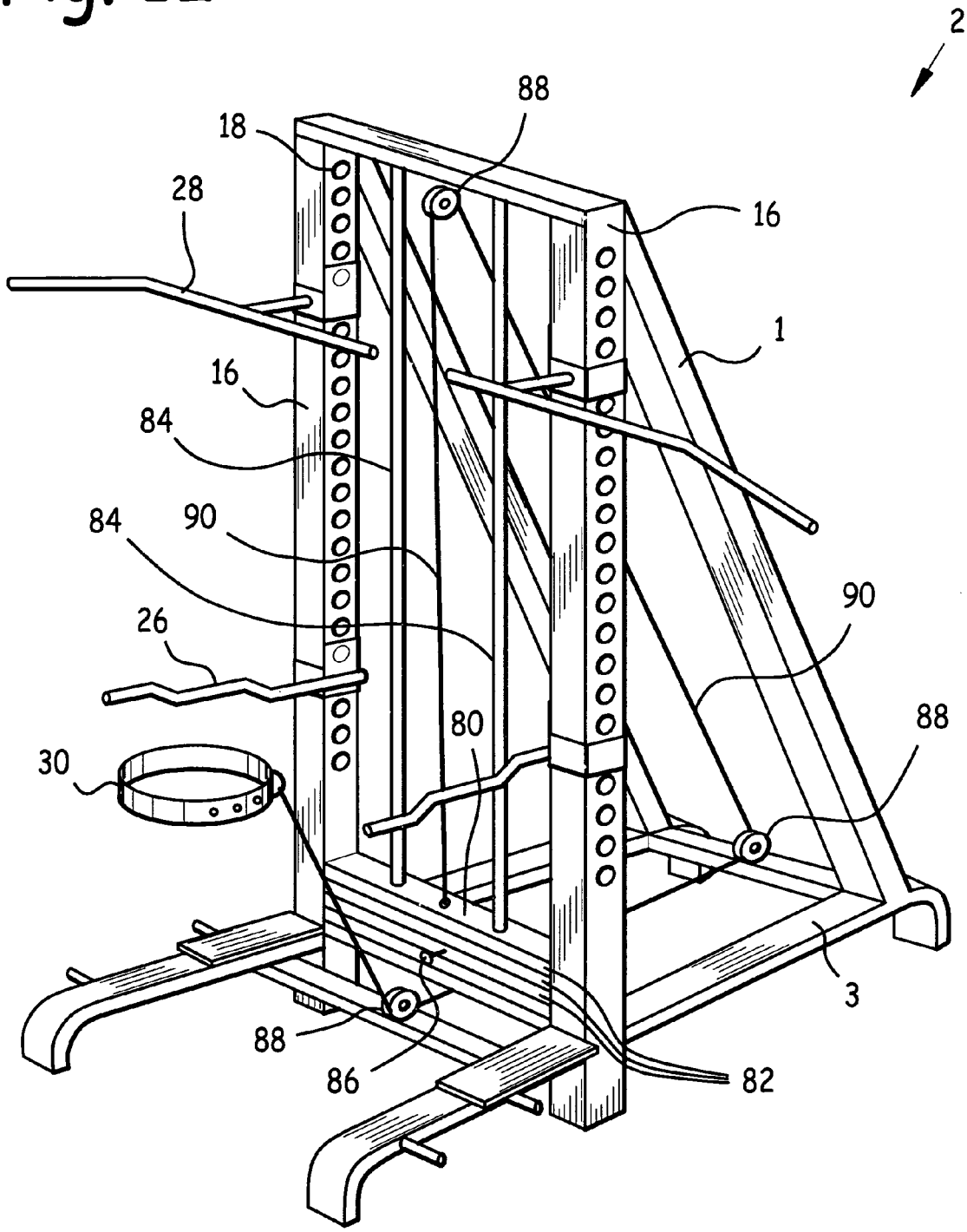
FIG. 12 is a right quarter side isometric view of an alternate embodiment adjustable weight-loaded dip-chin machine incorporating a weight stack.

FIG. 12 is a right quarter side isometric view of an alternate embodiment adjustable dip-chin machine 2 incorporating weight stack 80. Weight stack 80 comprises a plurality of stack weights 82 sliding on weight guides 84. The placement of stack pin 86 determines the amount of stack weights 82 which will be connected to cable 90. Cable 90 is attached to weight stack 80, then is routed through pulleys 88 attached to frame 1 and base 3, and finally attaches to belt 30.

When an exerciser wearing belt 30 moves upwards while performing a dip or chin, belt 30 pulls cable 90, which in turn raises a number of stack weights 82 determined by the placement of stack pin 86. In this embodiment of adjustable dip-chin machine 2, the exerciser and/or trainer determine an appropriate amount of weight to be added for the exercise, stack pin 86 is set accordingly, and then the exerciser performs the dips and/or chins, these exercises being rendered appropriately more strenuous by the addition of weight from weight stack 80.

In addition, as in the preferred embodiment of adjustable dip-chin machine 2 previously described, one or more elastic bands can attach belt 30 to base 3, and chain 36 or other appropriate weight may be attached to belt 30. Weight stack 80, elastic bands 24, and chain 36 exert force against the exerciser's upward motion while performing dips and chins, thus increasing the strenuousness of these exercises as desired by the exerciser and/or the trainer.

Weight stacks 80 are old and well-known in the industry. Thus, although the particular weight stack 80 depicted in FIG. 12 shows stack weights 82 selected by stack pin 86 sliding on weight guides 84, it is intended to fall within the scope of this invention that any weight stack configuration known in the art may be used to supply downward force to belt 30, as described above.

Figure 13:
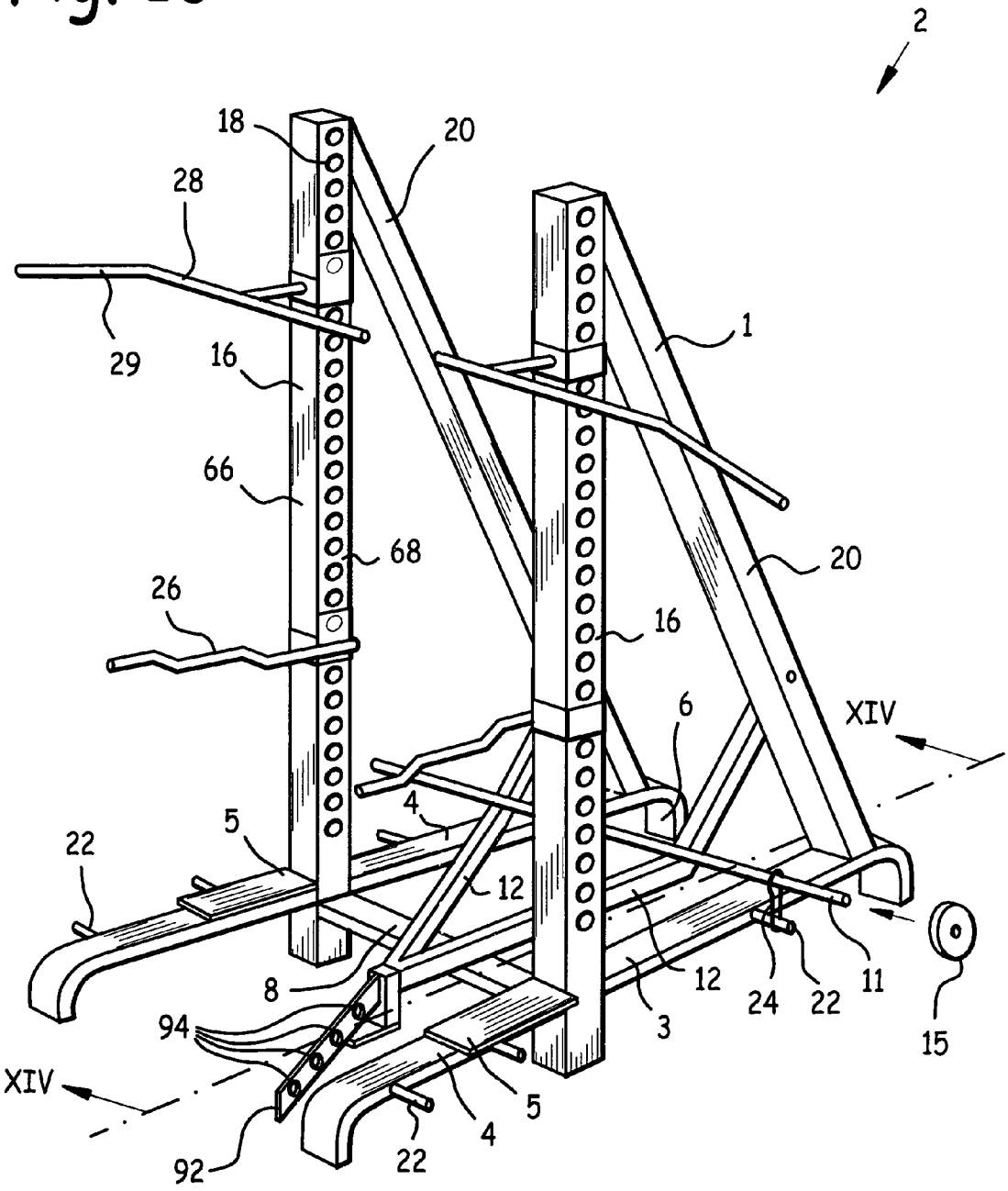
FIG. 13 is a right quarter side isometric view of an alternate embodiment adjustable weight-loaded dip-chin machine incorporating an arm extension.
Figure 14:
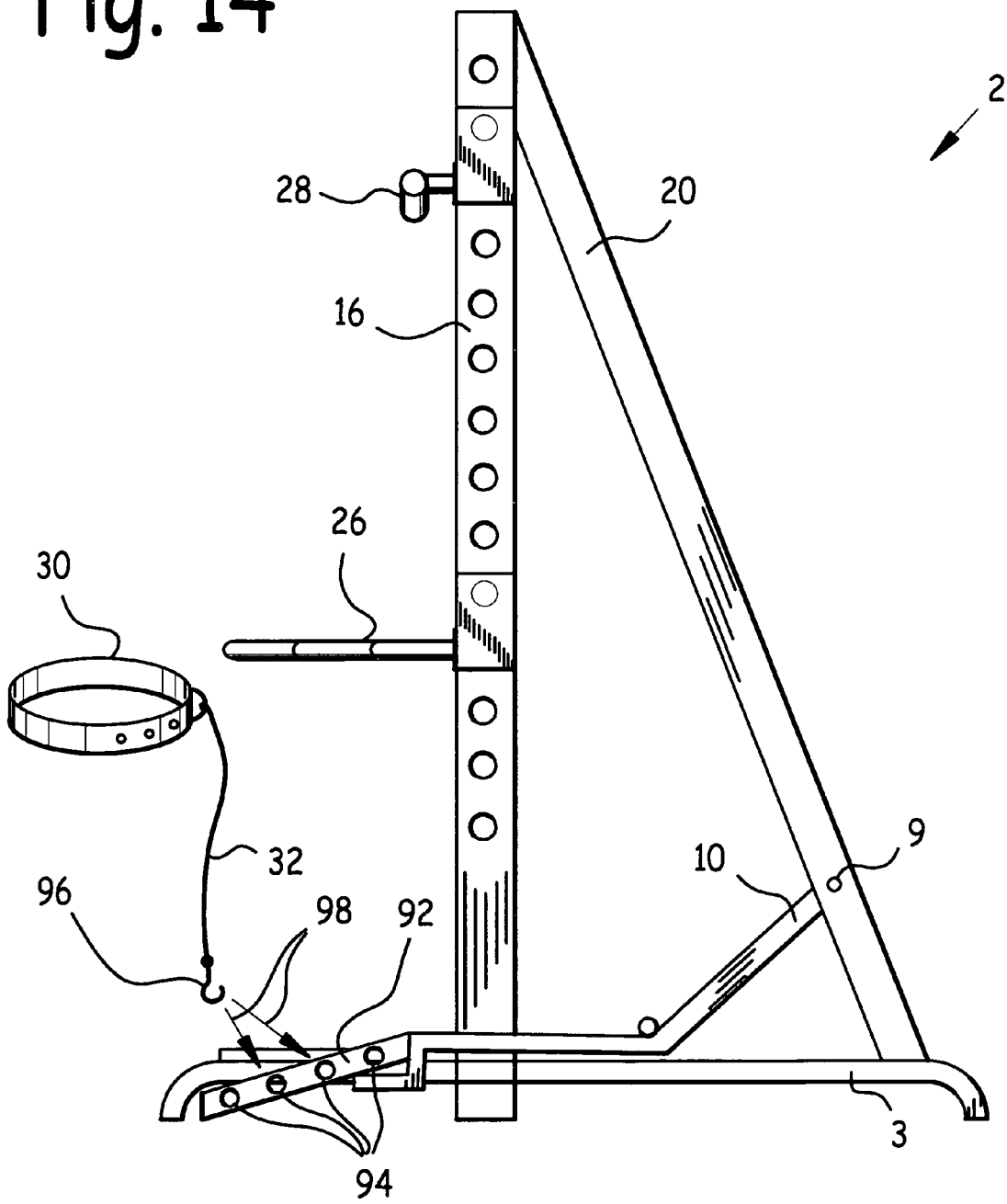
FIG. 14 is a right side cross-sectional view, taken at section XIV-XIV of FIG. 13, of an alternate embodiment adjustable weight-loaded dip-chin machine incorporating an arm extension, with its arm in the resting position.

FIG. 13 is a right quarter side isometric view of an alternate embodiment adjustable dip-chin machine 2 incorporating arm extension 92 rigidly attached to an end of arm 10 opposite column braces 20. FIG. 14 is a right side cross-sectional view, taken at section XIV-XIV of FIG. 13, of an alternate embodiment adjustable dip-chin machine 2 incorporating arm extension 10, with arm 10 in the resting position.

In this alternate embodiment of adjustable dip-chin machine 2, arm extension 92 incorporates a plurality of arm extension apertures 94 sized to admit belt line hook 96. In use, the user inserts belt link hook 96 into the most comfortable arm extension aperture 94, then proceeds with exercising. As previously mentioned, differently-sized exercisers may be accommodated by varying their distance from the other dip bar 26. In the embodiment depicted in FIG. 7, each dip bar 26 comprised a dip bar first leg 61, a dip bar second leg 63 spaced farther away from the other dip bar 26 than dip bar first leg 61, and a dip bar third leg 65, spaced farther away from the other dip bar 26 than dip bar second leg 63. As may be observed in FIG. 7, the farther the exerciser moves from columns 16, the farther apart dip bars 26 are spaced. The exerciser has merely to choose the dip bar 26 separation best suited for the dips being performed.

Thus, the distance of an exerciser from columns 16 may vary, and the exerciser's position along foot supports 5 may vary. Depending on the distance of the exerciser from columns 16, the exerciser may wish to change the attached point of belt line 32 along arm extension 92, after donning belt 30 for exercise using the instant invention as described previously. The exerciser accomplishes this objective by inserting belt line hook 96 into the arm extension aperture 94 which is most comfortable and appropriate in view of the exerciser's distance from columns 16, as indicated by arrows 98.

Figure 15:
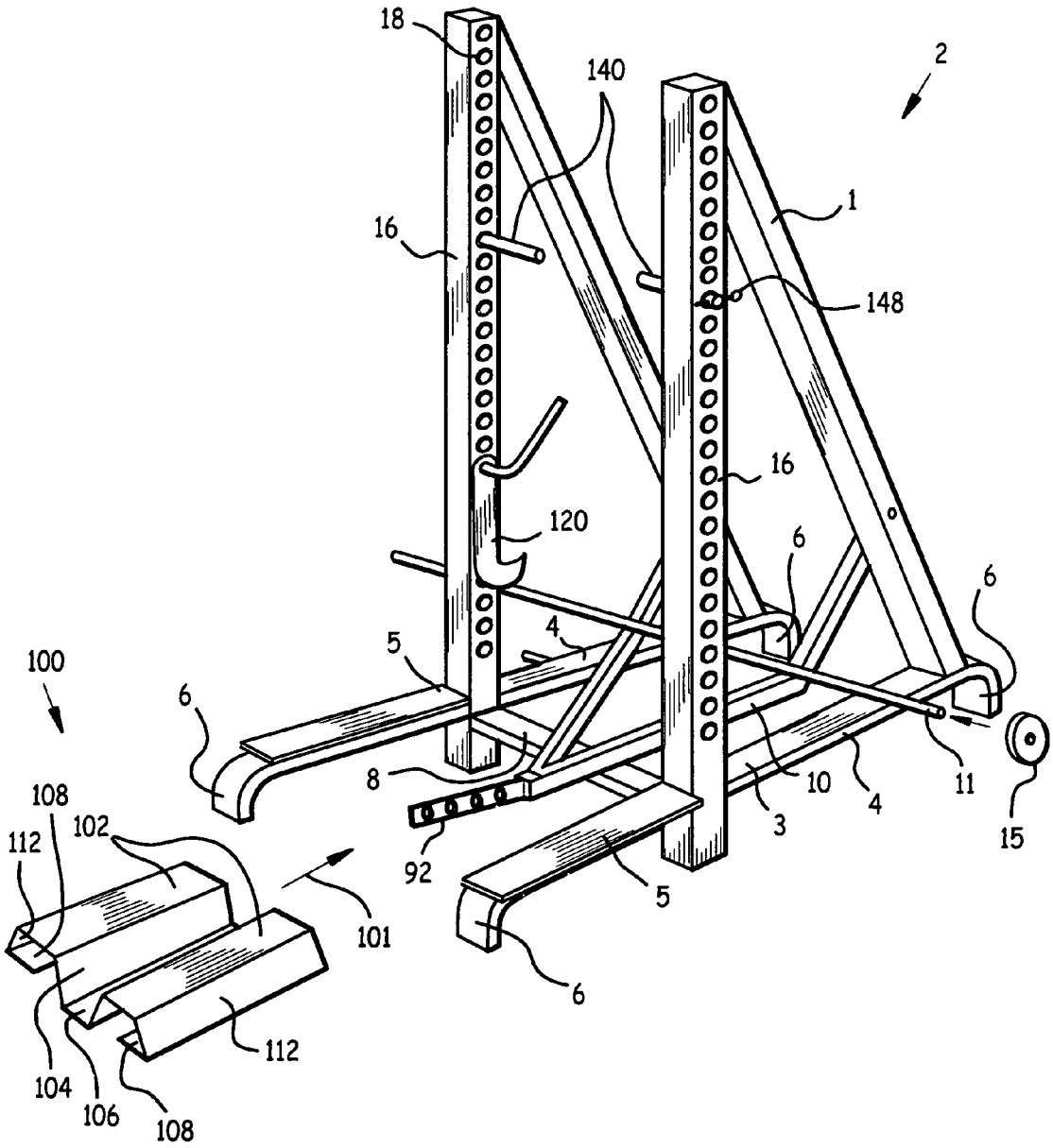
FIG. 15 is a right quarter side isometric view of an adjustable weight-loaded dip-chin machine incorporating a squat platform, pivot hook, and squat handles, with its arm in the resting position.
Figure 16:
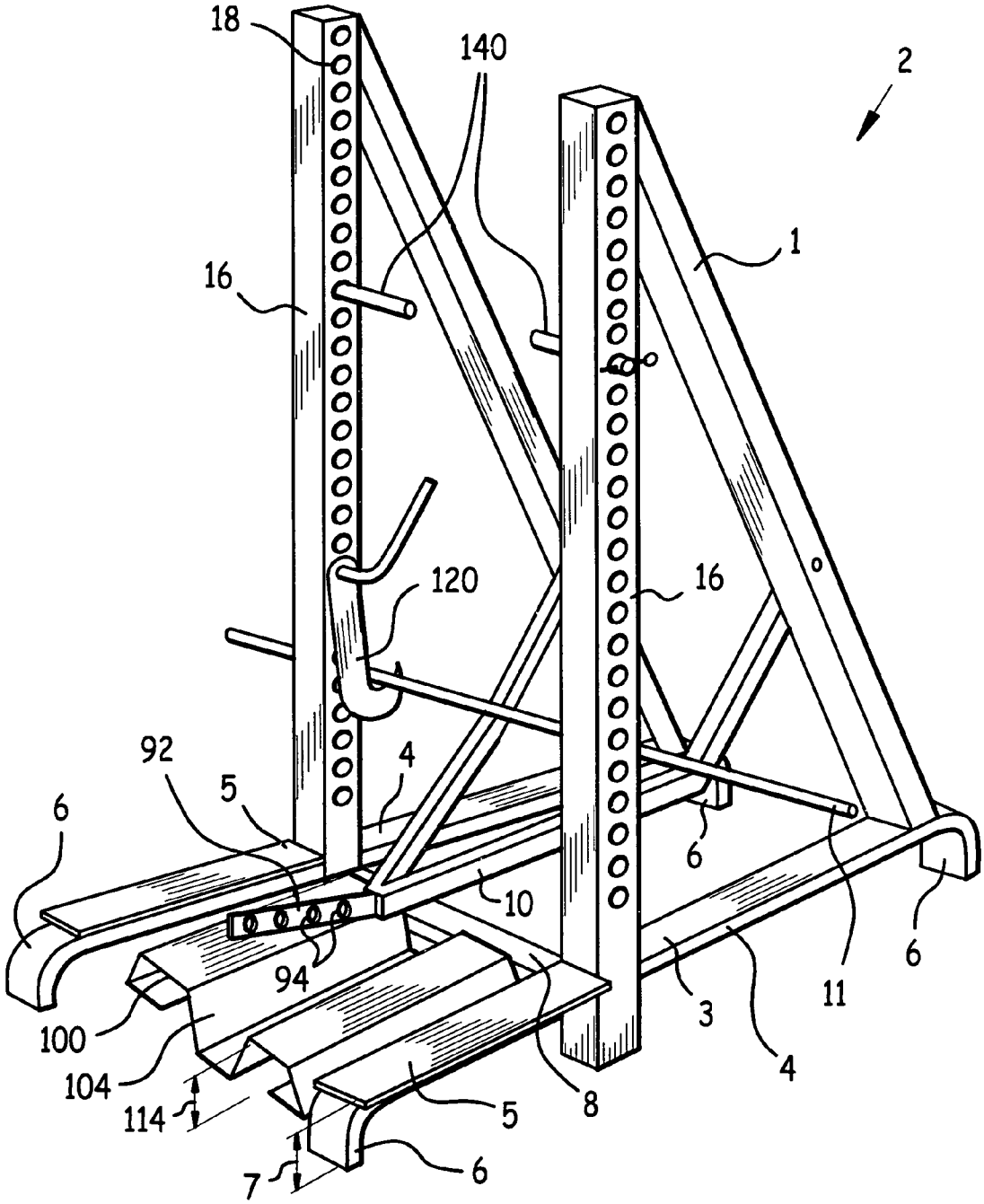
FIG. 16 is a right quarter side isometric view of an adjustable weight-loaded dip-chin machine incorporating a squat platform, pivot hook, and squat handles, with its arm being held in the elevated position by the pivot hook.

Referring now to FIG. 15 we observe a right quarter side isometric view of adjustable weight-loaded dip-chin machine 2 incorporating squat platform 100, pivot hook 120, and squat handles 140, with arm 10 in the resting position on arm support 8. FIG. 16 is a right quarter side isometric view of adjustable weight-loaded dip-chin machine 2 incorporating squat platform 100, pivot hook 120, and squat handles 140, with its arm 10 being held in the elevated position by pivot hook 120.

Figure 17:
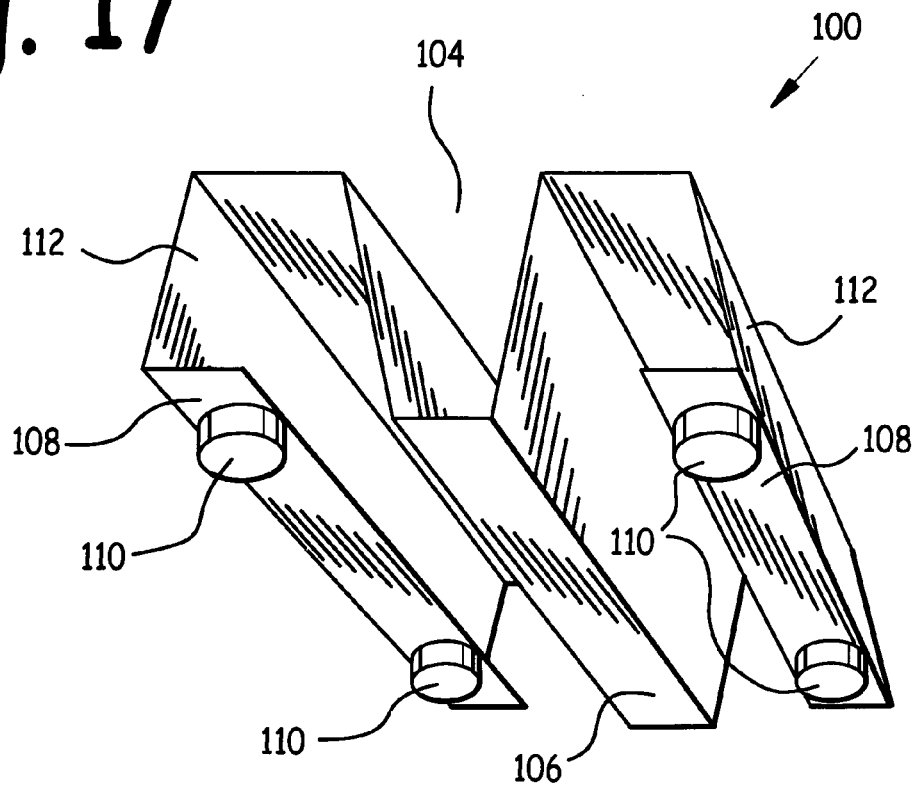
FIG. 17 is a lower end view of a squat platform.
Figure 18:
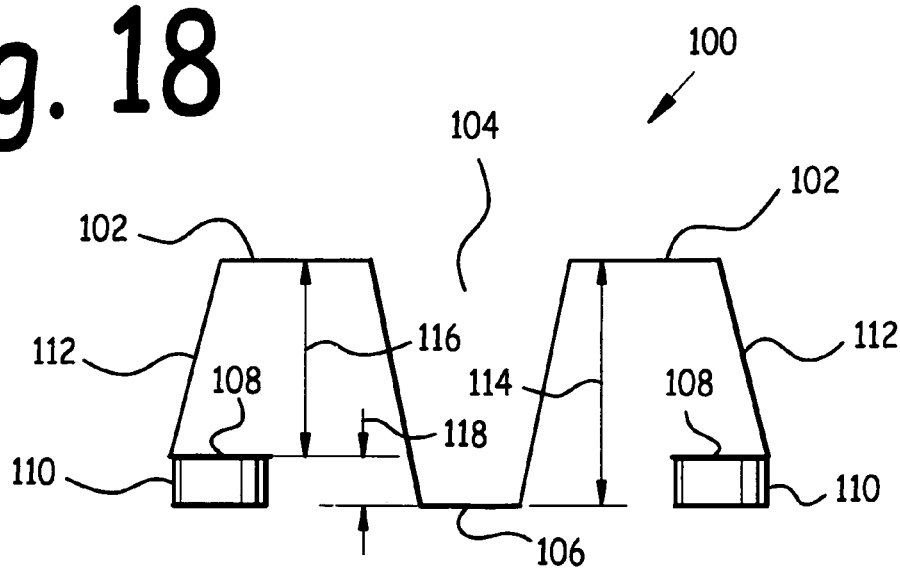
FIG. 18 is an end view of a squat platform.

FIG. 17 is a lower end view of squat platform 100. FIG. 18 is an end view of squat platform 100.

As may be observed in these figures, squat platform 100 comprises platform deck 102 supported along opposite edges by platform sides 112. Platform groove 104 in platform deck 102 is sized to admit arm extension 92 when arm 10 is resting on arm support 8 in the resting position.

Squat platform 100 further comprises a platform side foot 108 attached to each platform side 112 along an edge of each platform side 112 opposite platform deck 102. Platform anti-slip pads 110 are attached to the undersides of each platform side foot 108, and serve to help hold squat platform 100 in position.

Squat platform 100 further comprises a platform center foot 106 for additional support and stability.

As may be observed in FIG. 18, the sum of platform side height 116 and platform anti-slip pad height 118 is substantially equal to platform height 114. As a result of this dimensionality, platform anti-slip pads 110 and platform center foot 106 all rest upon the floor, not only producing an extremely well-supported and stable platform deck 102, but also preventing squat platform 100 from sliding around, because part of its weight is supported by platform anti-slip pads 110.

Squat platform 100 may be inserted between foot supports 5 for use, as indicated by arrow 101 in FIG. 15, into the position depicted in FIG. 16. As may be noted, squat platform height 114 is substantially equal to foot support height 7. Platform anti-slip pads 110 help hold squat platform 100 securely in position between foot supports 5.

Thus, when squat platform 100 is emplaced between foot supports 5 as depicted in FIG. 16, platform deck 102 in combination with foot supports 5 produce a flat surface for the exerciser to stand on, interrupted only by platform groove 104 and the narrow gaps between squat platform 100 and foot supports 5. This feature of the instant invention contributes greatly to the convenience, comfort, and safety of the instant invention by providing a stable, non-slip surface upon which the exerciser can stand. In addition, this feature contributes greatly to the versatility of the instant invention, because exercisers having different widths of foot prints can use the apparatus, be they large individuals, or smaller women and children.

Figure 19:
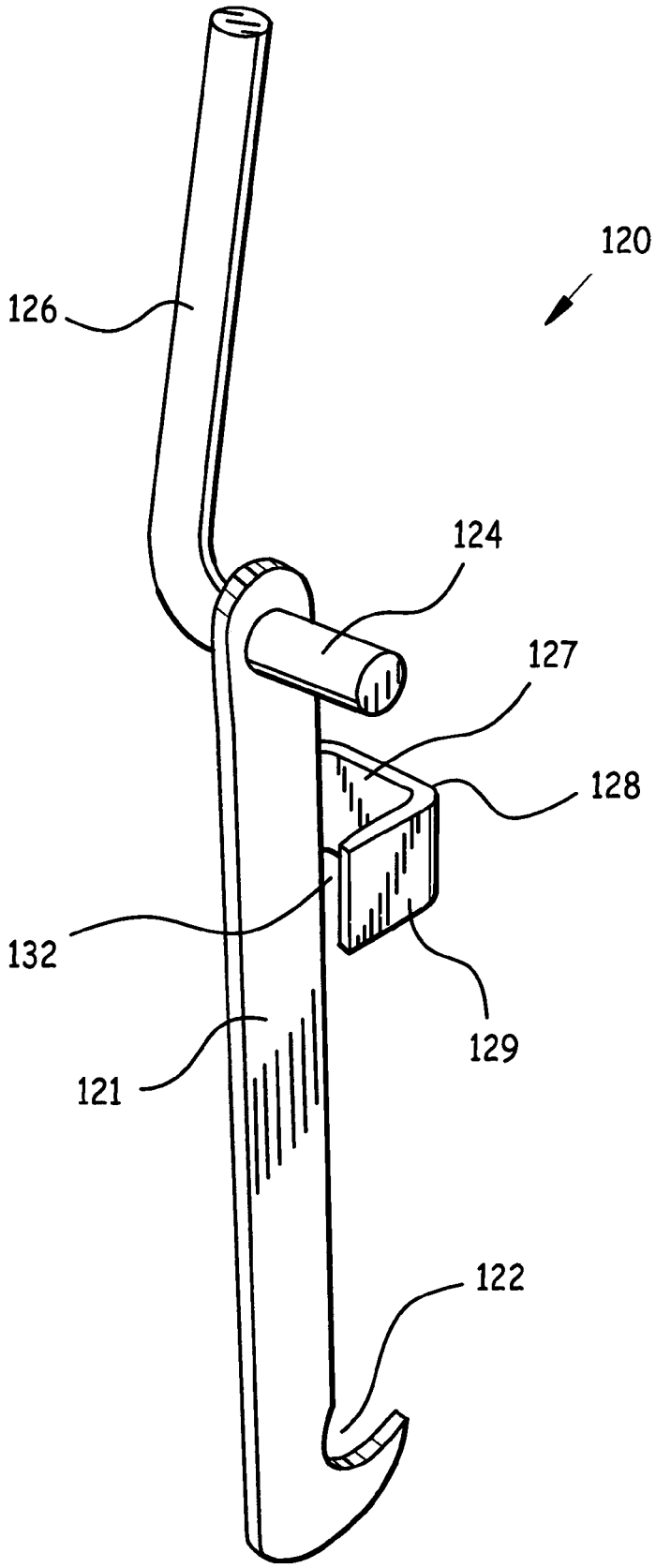
FIG. 19 is a right quarter side isometric view of a pivot hook.
Figure 20:
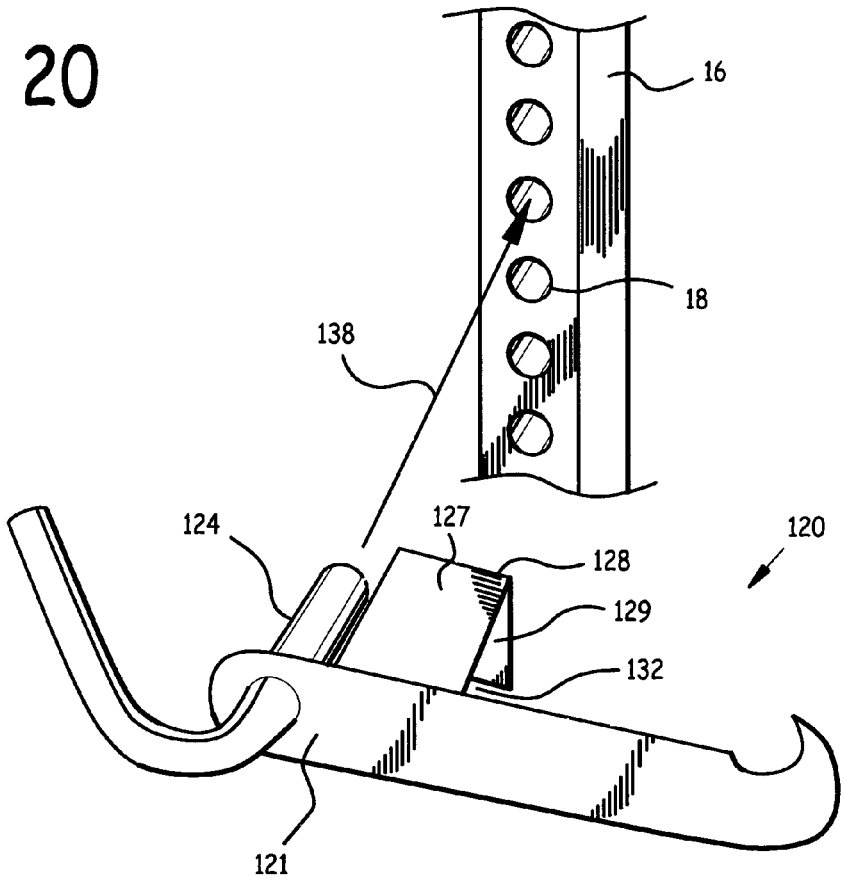
FIG. 20 is a right quarter side isometric view of a pivot hook about to be rotatably installed on a column.
Figure 21:
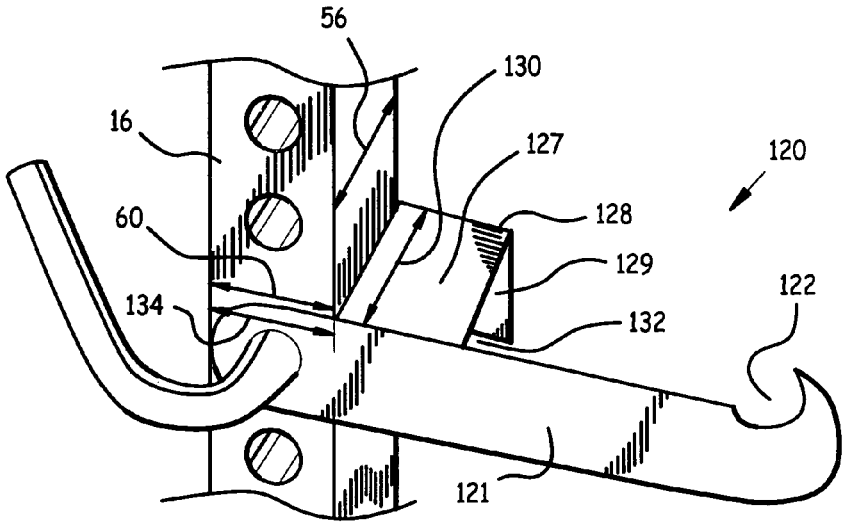
FIG. 21 is a right quarter side isometric view of a pivot hook pivotally installed on a column, at a right angle to the column.
Figure 22:
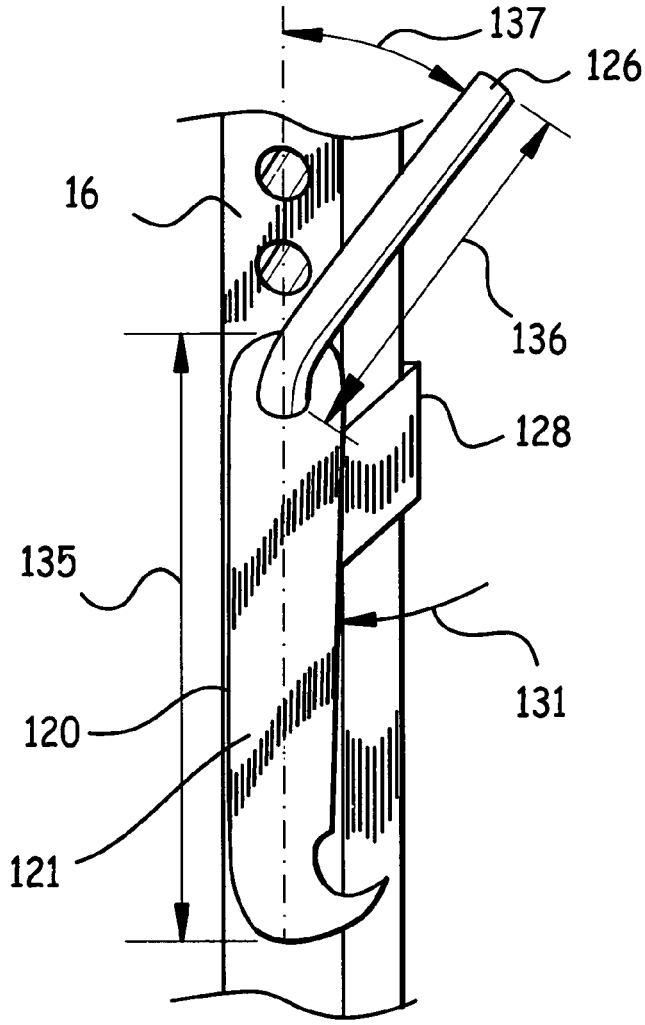
FIG. 22 is a right quarter side isometric view of a pivot hook pivotally installed on a column, hanging downwards parallel to the column as urged by gravity.

FIG. 19 is a right quarter side isometric view of pivot hook 120. FIG. 20 is a right quarter side isometric view of pivot hook 120 about to be pivotally installed on column 16. FIG. 21 is a right quarter side isometric view of a pivot hook 120 pivotally installed on column 16, at a right angle to column 16. FIG. 22 is a right quarter side isometric view of pivot hook 120 pivotally installed on column 16, hanging downwards parallel to column 16 as urged by gravity.

Referring now to these figures, and also FIGS. 15 and 16, pivot hook 120 comprises pivot hook aperture 122 at one end of pivot hook arm 121. Pivot hook aperture 122 is sized to admit arm spindle 11. Pivot hook pin 124 and pivot hook handle 126 are attached to the end of pivot hook arm 121 opposite pivot hook aperture 122.

Pivot hook 120 additionally comprises pivot hook bracket 128 attached to pivot hook arm 121 between pivot hook pin 124 and pivot hook aperture 122. Pivot hook bracket 128 is sized to embrace column 16, as depicted in FIG. 22, in order to act as a stop against rotation of pivot hook 120 relative to column 16.

Pivot hook bracket 128 comprises pivot hook leg 129 rigidly attached to pivot hook bracket spine 127. One edge of pivot hook bracket spine 127 is attached to pivot hook arm 121; pivot hook bracket leg 129 is attached to an edge of pivot hook bracket spine 127 opposite pivot hook arm 121. As may be observed in FIG. 21, pivot hook bracket spine width 130 is substantially equal to or greater than column width 56, in order to allow pivot hook bracket 128 to embrace column 16 as depicted in FIG. 22. Pivot hook arm 121, pivot hook bracket spine 127, and pivot hook bracket leg 129 define pivot hook bracket aperture 132, sized to admit column 16.

Pivot hook 120 serves to hold arm 10 in an elevated position such as is depicted in FIG. 16, so that an exerciser may conveniently attach belt line 32 to arm 10, e.g. by inserting belt line hook 96 through an arm extension aperture 94. Advantages in elevating arm 10 prior to so doing include increased ease of use and safety to exercisers using the machine, because exercisers can set the amount of weights desired, attach belt line 32 to arm 10 while arm 10 is elevated, raise arm 10 by standing up out of the mild squat required to attach belt line hook 96 to arm 10, and then during subsequent exercise squat as low as desired. Following this procedure permits the first squat to be mild and easy, and subsequent squats to be as low as the exerciser wishes.

When the exerciser wishes to cease exercising, pivot hook 120 can be easily engaged by pulling pivot hook handle 126 towards the exerciser and lowering arm 10 until arm spindle 11 rests within pivot hook aperture 122. This procedure is safer and less injury-prone than squatting deeply at the conclusion of the squat exercise series until arm 10 rests on arm support 8 as depicted in FIG. 15.

Because the height of pivot hook 120 may be varied according to which column aperture 18 pivot hook pin 124 is inserted, the elevated height of arm 10 may be varied as desired when arm spindle 11 is disposed within pivot hook aperture 122, which contributes greatly to the convenience and safety of the instant invention. One reason for this is the ability to rotatably attach pivot hook 120 at a height on column 16 appropriate to the size of the individual exerciser.

Thus, an important feature of the instant invention is the vertical adjustability of pivot hook 120 relative to column 16. FIGS. 20-22 depict pivot hook 120 being installed on a column 16, the first step of which is to insert pivot hook pin 124 into a column aperture 18 at a desired height, as indicated by arrow 138 in FIG. 20. Pivot hook pin 124 is sized to slidably fit into column apertures 18.

After pivot hook pin 124 is inserted in a column aperture 18 as depicted in FIG. 21, pivot hook 120 is allowed to rotate down around pivot hook pin 124 under the influence of gravity as indicated by arrow 131 in FIG. 22, until column 16 is disposed within pivot hook bracket aperture 132, as depicted in FIG. 22.

Pivot hook 120 may be re-positioned on column 16 by merely reversing the above steps, and then re-installing pivot hook 120 on column 16 using a different column aperture 18, as desired.

As may be observed in FIG. 21, in the preferred embodiment pivot hook bracket 128 was disposed at a pivot hook bracket offset distance 134 from the end of pivot bracket arm 121 opposite pivot hook aperture 122 substantially equal to or greater than column depth 60. This dimensional relationship avoided mechanical interference between pivot hook bracket 128 and column 16 when sliding pivot hook pin 124 into a column aperture 18.

Another important feature of the instant pivot hook 120 design is its ability to automatically disengage from arm spindle 11 when arm spindle 11 is lifted. This automatic disengagement is provided by the natural force of gravity in two ways. First, as urged by gravity, pivot hook arm 121 will tend to hang vertically downwards from pivot hook pin 124. Second, the gravity force moment acting on pivot hook arm 121 due to the pivot hook handle angle 137 between pivot hook handle 126 and the longitudinal axis of pivot hook arm 121 tends to urge pivot arm 121 to rotate down as indicated by arrow 131 in FIG. 22, until this rotation is stopped by pivot hook bracket 128, and hold pivot hook bracket 128 in intimate engagement with column 16.

Thus, the value of pivot arm handle angle 137, as well as the dimensional relationship between pivot hook handle length 136 and pivot hook arm length 135, is important to the function of automatic disengagement of pivot hook 120 from arm spindle 11, and its subsequent retention it the stowed position shown in FIG. 22. In the preferred embodiment, pivot hook handle angle 137 was 40±20 degrees, and pivot hook handle length 136 was 38%±20% of pivot hook arm length 135.

Figure 23:
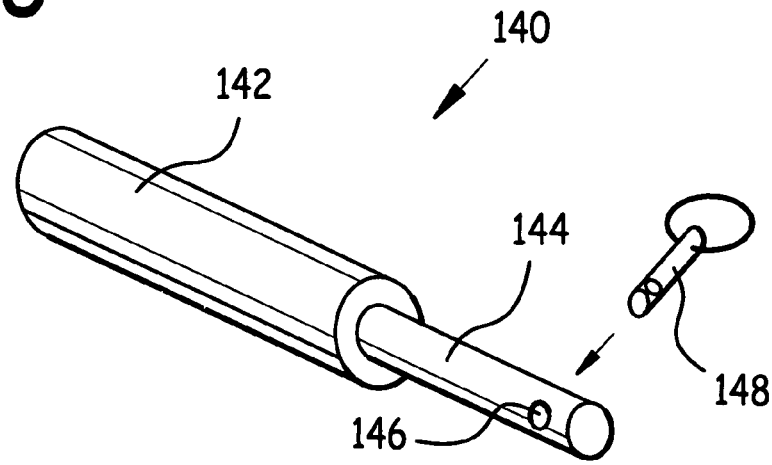
FIG. 23 is a right quarter side isometric view of a squat handle.

FIG. 23 is a right quarter side isometric view of squat handle 140. Squat handles 140 may be installed through any column aperture 18 desired, thus providing vertical adjustability. Squat handle 140 comprises squat handle hand grip 142 rigidly attached to squat handle pin 144. Squat handle pin 144 is sized to slidably fit into column apertures 18. The cross-sectional area of squat handle hand grip 142 exceeded that of squat handle pin 144, thus allowing squat handle hand grip 142 to act as a stop when squat handle pin 144 is inserted into a column aperture 18. Squat handle pin aperture 146 sized to slidably admit safety pin 148 is disposed at an end of squat handle pin 144 opposite squat handle hand grip 144.

Once squat handle pin 144 has been slid through an appropriate column aperture 18, safety pin 48 is slid through squat handle pin aperture 146 to lock squat handle 140 in place onto column 16.

In the preferred embodiment, frame 1, base 3, arm 10, brackets 40, dip bars 26, chin bars 28, squat platform 100, pivot hook 120 and squat handles 140 were made of metal, synthetic, or any other appropriate material. Belt 30 was a conventional exercise weight belt. Belt line 32 and cable 90 were any appropriate elongate member, including cable, rope, synthetic, chain, etc. Chain 36 was conventional metal link chain or other appropriate chain. Weight stack 80 was a commercially available weight stack. Squat platform anti-slip pads 110 were made of rubber, synthetic, or any other appropriate anti-slip material.

While a preferred embodiment of the invention has been illustrated herein, it is to be understood that changes and variations may be made by those skilled in the art without departing from the spirit of the appending claims.

DRAWING ITEM INDEX 1 frame
2 adjustable dip-chin machine
3 base
4 leg
5 foot support
6 foot
7 foot support height
8 arm support
9 arm pivot point

10 arm
11 arm spindle
12 arm brace
14 arm ring
15 weight
16 column
18 column aperture
20 column brace
22 peg
24 elastic band
26 dip bar
28 chin bar
29 chin bar dogleg
30 belt
31 chin bar dogleg angle
32 belt line
33 chin bar support
34 arrow
36 belt weight
38 arrow
40 bracket
42 bracket spine
44 bracket first leg
46 bracket second leg
48 bracket second leg extension
50 bracket aperture
52 bracket pin
54 bracket aperture width
56 column width
58 bracket second leg extension depth
60 column depth
61 dip bar first leg
62 column aperture offset
63 dip bar second leg
64 bracket pin offset
65 dip bar third leg
66 column face
68 column spine
70 arrow
72 arrow
74 arrow
80 weight stack
82 stack weight
84 weight guide
86 stack pin
88 pulley
90 cable
92 arm extension
94 arm extension aperture
96 belt line hook
98 arrow
100 squat platform
101 arrow
102 platform deck
104 platform groove
106 platform center foot
108 platform side foot
110 platform anti-slip pad
112 platform side
114 platform height
116 platform side height
118 platform anti-slip pad height
120 pivot hook
121 pivot hook arm
122 pivot hook aperture
124 pivot hook pin
126 pivot hook handle
127 pivot hook bracket spine
128 pivot hook bracket
129 pivot hook bracket leg
130 pivot hook bracket spine width
131 arrow
132 pivot hook aperture
134 pivot hook bracket offset distance
135 pivot hook arm length
136 pivot hook handle length
137 pivot hook handle angle
138 arrow
140 squat handle
142 squat handle hand grip
144 squat handle pin
146 squat handle pin aperture
148 safety pin

I claim:

1. An adjustable dip-chin machine comprising an arm and a base, said arm being pivotally attached to said base, weights, an arm spindle attached to said arm, said arm spindle being sized to accept said weights, at least one substantially vertical column rigidly attached to said base, a pivot hook and means of removably and rotatably attaching said pivot hook to said column, said pivot hook comprising a pivot hook aperture sized to releasably admit said arm spindle and admitting said arm spindle, said arm spindle being disposed within said pivot hook aperture when said pivot hook is engaged, whereby said arm may be releasably held in an elevated position.

2. An adjustable dip-chin machine comprising an arm pivotally attached to a base, an arm spindle attached to said arm, said arm spindle being sized to accept weights, at least one substantially vertical column rigidly attached to said base, a pivot hook, means of removably and rotatably attaching said pivot hook to said column, said pivot hook comprising a pivot hook aperture sized to releasably admit said arm spindle, said arm spindle being disposed within said pivot hook aperture when said pivot hook is engaged, and means of automatically releasing said arm spindle from said pivot hook when said arm is raised, whereby an exerciser, may commence exercise from a relatively erect position by raising said arm, thereby automatically releasing said pivot hook from said arm.

3. An adjustable dip-chin machine comprising an arm pivotally attached to a base, an arm spindle attached to said arm, said arm spindle being sized to accept weights, at least one substantially vertical column, a pivot hook, means of removably and rotatably attaching said pivot hook to said column, said pivot hook comprising a pivot hook aperture sized to releasably admit said arm spindle, said column comprising a plurality of column apertures, said pivot hook comprising a pivot hook arm, said pivot hook aperture being disposed at one end of said pivot arm, said means of removably and rotatably attaching said pivot hook to said column comprising a pivot hook bracket attached to said pivot hook arm, said pivot hook bracket comprising a pivot hook bracket leg attached along one edge of a pivot hook bracket spine, said pivot arm being attached along an opposite edge of said pivot hook bracket spine, said pivot hook arm, pivot hook bracket spine, and said pivot hook bracket leg defining a pivot hook bracket aperture, said pivot hook bracket aperture being sized to admit said column, and a pivot hook pin attached to an end of said pivot arm opposite said pivot hook aperture, each said column aperture being sized to admit said pivot hook pin, whereby said pivot hook pin may be inserted into one said column aperture, and then said pivot hook rotated about said pivot hook pin until said column is disposed within said pivot hook bracket aperture.

4. The adjustable dip-chin machine of claim 2 wherein said means of automatically releasing said arm spindle from said pivot hook comprises a pivot hook handle attached to an end of said pivot hook arm opposite said pivot hook aperture, said pivot hook handle being attached to said pivot hook arm at a pivot hook handle angle relative to a longitudinal axis of said pivot hook arm.

5. The adjustable dip-chin machine of claim 4 wherein said pivot hook handle angle is substantially 40±20 degrees.

6. The adjustable dip-chin machine of claim 5 wherein a length of said pivot hook handle is substantially 38%±20% of a length of said pivot hook arm.

7. An adjustable dip-chin machine comprising an arm pivotally attached to a base, an arm spindle attached to said arm, said arm spindle being sized to accept weights, at least one substantially vertical column, a pair of legs, each said leg being supported by a foot at each end, a foot support mounted on each said leg, a squat platform sized to fit between said foot supports, a height of said squat platform substantially equaling a height of said foot supports, an arm extension rigidly attached to an end of said arm opposite said base, and a platform groove in said platform deck, said platform groove being sized to admit said arm extension.

8. The adjustable dip-chin machine of claim 7 wherein said squat platform further comprises a center foot, a pair of platform side feet, and at least one platform anti-slip pad attached to each said platform side foot, and wherein each said platform side foot is attached to said deck by means of a respective platform side, a sum of a height of said platform anti-slip pad and a height of said platform side being substantially equal to a height of said squat platform, whereby said squat platform rests on said side feet and said center foot when disposed upon a flat surface, and whereby said platform anti-slip pads help prevent said squat platform from slipping across said surface upon which it rests.

9. An adjustable dip-chin machine comprising an arm pivotally attached to a base, an arm spindle attached to said arm, said arm spindle being sized to accept weights, at least one substantially vertical column, at least one elongate squat handle, and a plurality of column apertures in said column, said squat handle comprising an elongate squat handle hand grip rigidly attached to an elongate squat handle pin, said squat handle pin being sized to slidably fit into each said column apertures, said squat handle hand grip and said squat handle pin having substantially a same longitudinal axis.

10. The adjustable dip-chin machine of claim 9 wherein said squat handle further comprises a squat handle pin aperture extending through an end of said squat handle pin opposite said squat handle hand grip, and a safety pin sized to fit through said squat handle pin aperture, whereby said squat handle pin may be inserted through one said column aperture until an end of said squat handle pin protrudes from said column aperture, and said safety pin may be inserted through said squat handle pin aperture, thus locking said squat handle onto said column.

11. The adjustable dip-chin machine of claim 4 further comprising at least one dip bar, and means of adjusting dip bar height comprising a bracket attached to said dip bar comprising a bracket first leg attached along one edge of a bracket spine, and a bracket second leg attached along an opposite edge of said bracket spine, said bracket first leg, bracket second leg, and bracket spine defining a bracket aperture, said bracket aperture being sized to admit said column, and a bracket pin attached to said bracket second leg, each said column aperture being sized to admit said bracket pin, whereby said bracket pin may be inserted into one said column aperture, and then said bracket rotated about said bracket pin until said column is disposed within said bracket aperture.

12. The adjustable dip-chin machine of claim 11 wherein said column comprises a pair of opposed column faces and a pair of opposed column sides, said plurality of column apertures being disposed in one said column side, and said bracket further comprises a bracket second leg extension and said bracket pin is mounted to said bracket second leg extension, a bracket pin offset from said bracket spine equaling or exceeding a column aperture offset from an adjacent said column face.

13. The adjustable dip-chin machine of claim 4 further comprising a chin bar and means of adjusting chin bar height comprising a bracket attached to said chin bar, said bracket comprising a bracket first leg attached along one edge of a bracket spine and a bracket second leg attached along an opposite edge of said bracket spine, said bracket first leg, bracket second leg, and bracket spine defining a bracket aperture, said bracket aperture being sized to admit said column, and a bracket pin attached to said bracket second leg, each said column aperture being sized to admit said bracket pin, whereby said bracket pin may be inserted into one said column aperture, and then said bracket rotated about said bracket pin until said column is disposed within said bracket aperture.

14. The adjustable dip-chin machine of claim 13 wherein said column comprises a pair of opposed column faces and a pair of opposed column sides, said plurality of column apertures being disposed in one said column side, and said bracket further comprises a bracket second leg extension and said bracket pin is mounted to said bracket second leg extension, a bracket pin offset from said bracket spine equaling or exceeding a column aperture offset from an adjacent said column face.

15. An adjustable dip-chin machine comprising an arm pivotally attached to a base, an arm spindle attached to said arm, said arm spindle being sized to accept weights, at least one substantially vertical column rigidly attached to said base, a pivot hook comprising a pivot hook aperture sized to releasably admit said arm spindle, said arm spindle being disposed within said pivot hook aperture when said pivot hook is engaged, means of removably and rotatably attaching said pivot hook to said column, and means of automatically releasing said arm spindle from said pivot hook when said arm is raised, whereby an exerciser may commence exercise from a relatively erect position by raising said arm, thereby automatically releasing said pivot hook from said arm.

16. The adjustable dip-chin machine of claim 15 wherein said column comprises a plurality of column apertures, wherein said pivot hook comprises a pivot hook arm, said pivot hook aperture being disposed at one end of said pivot arm, and wherein said means of removably and rotatably attaching said pivot hook to said column comprises a pivot hook bracket attached to said pivot hook arm, said pivot hook bracket comprising a pivot hook bracket leg attached along one edge of a pivot hook bracket spine, said pivot arm being attached along an opposite edge of said pivot hook bracket spine, said pivot hook arm, pivot hook bracket spine, and said pivot hook bracket leg defining a pivot hook bracket aperture, said pivot hook bracket aperture being sized to admit said column, and a pivot hook pin attached to an end of said pivot arm opposite said pivot hook aperture, each said column aperture being sized to admit said pivot hook pin, whereby said pivot hook pin may be inserted into one said column aperture, and then said pivot hook rotated about said pivot hook pin until said column is disposed within said pivot hook bracket aperture.

17. The adjustable dip-chin machine of claim 15 wherein said means of automatically releasing said arm spindle from said pivot hook comprises a pivot hook handle attached to an end of said pivot hook arm opposite said pivot hook aperture, said pivot hook handle being attached to said pivot hook arm at a pivot hook arm angle.

18. The adjustable dip-chin machine of claim 17 further comprising a pair of legs, each said leg being supported by a foot at each end, a foot support mounted on each said leg, and a squat platform sized to fit between said foot supports, a height of said squat platform substantially equaling a height of said foot supports.

19. The adjustable dip-chin machine of claim 18 wherein said squat platform comprises a deck, a pair of platform side feet, and at least one platform anti-slip pad attached to each said platform side foot.

20. The adjustable dip-chin machine of claim 19 further comprising an arm extension rigidly attached to an end of said arm opposite said base, and wherein said squat platform further comprises a platform groove in said platform deck, said platform groove being sized to admit said arm extension.

21. The adjustable dip-chin machine of claim 20 wherein said squat platform further comprises a center foot, and wherein each said platform side foot is attached to said deck by means of a respective platform side, a sum of a height of said platform anti-slip pad and a height of said platform side being substantially equal to a height of said squat platform, whereby said squat platform rests on said side feet and said center foot when disposed upon a flat surface, and whereby said platform anti-slip pads help prevent said squat platform from slipping across said surface upon which it rests.

22. The adjustable dip-chin machine of claim 21 further comprising at least one squat handle, and a plurality of column apertures in said column, said squat handle comprising a squat handle hand grip rigidly attached to a squat handle pin, said squat handle pin being sized to slidably fit into each said column apertures, a cross-sectional area of said squat handle hand grip exceeding a cross-sectional area of said squat handle pin.

23. The adjustable dip-chin machine of claim 22 wherein said squat handle further comprises a squat handle pin aperture extending through an end of said squat handle pin opposite said squat handle hand grip, and a safety pin sized to fit through said squat handle pin aperture, whereby said squat handle pin may be inserted through one said column aperture until an end of said squat handle pin and said squat handle pin aperture protrude from said column aperture, and said safety pin may be inserted through said squat handle pin aperture, thus locking said squat handle onto said column.

24. The adjustable dip-chin machine of claim 16 wherein a pivot hook bracket spine width equals or exceeds a column width, and wherein a pivot hook bracket offset distance from an end of said pivot hook arm opposite said pivot hook aperture equals or exceeds a column depth.

* * * * *